US006658128B1

(12) United States Patent
Yoshioka et al.

(10) Patent No.: US 6,658,128 B1
(45) Date of Patent: Dec. 2, 2003

(54) HORN LOUDSPEAKER

(75) Inventors: Tsutomu Yoshioka, Kobe (JP); Yasuhiro Fukunaka, Hyogo-ken (JP); Hiroshi Kubota, Nishinomiya (JP); Ken Iwayama, Sanda (JP)

(73) Assignee: TOA Corporation, Kobe (JP)

( * ) Notice: Subject to any disclaimer, the term of this patent is extended or adjusted under 35 U.S.C. 154(b) by 0 days.

(21) Appl. No.: 09/300,499

(22) Filed: Apr. 28, 1999

(30) Foreign Application Priority Data

Apr. 30, 1998 (JP) ..... 10-120718

(51) Int. Cl.[7] ..... H04R 1/02

(52) U.S. Cl. ..... 381/340; 181/177

(58) Field of Search ..... 381/340, 341, 381/342, 337, 338, 339, 182; 181/152, 159, 161, 177

(56) References Cited

U.S. PATENT DOCUMENTS 1,548,804 A * 8/1925 Darrah ..... 181/180
4,923,031 A * 5/1990 Carlson ..... 181/144
5,715,322 A * 2/1998 Yoshioka et al. ..... 381/182

* cited by examiner

*Primary Examiner*—Curtis Kuntz
*Assistant Examiner*—Brian Ensey
(74) *Attorney, Agent, or Firm*—Duane Morris LLP

(57) ABSTRACT

An electroacoustic transducer of a horn loudspeaker emits sound, which is supplied through a sound conduit pipe to a horn and propagated out of the horn through a mouth of the horn. The sound conduit pipe is coupled to the horn via a rectangular opening in the upper one of the upper and lower walls forming the horn, to thereby provide a linear sound source for the loudspeaker. The location where the sound conduit pipe is coupled to the horn and/or the tilt angle of the sound conduit pipe with respect to the horn may be varied to control the sound radiation characteristic of the loudspeaker.

3 Claims, 8 Drawing Sheets f = 1250 Hz f = 2500 Hz f = 5000 Hz f = 10000 Hz

HORN LOUDSPEAKER

This application is based on Japanese Patent Application No. HEI 10-120718 filed on Apr. 30, 1998, which is incorporated herein by reference.

This application relates to a horn loudspeaker.

BACKGROUND OF THE INVENTION

For a relatively large space, such as a hall and a conference room, a loudspeaker is usually disposed on a ceiling so that sound from the loudspeaker can be radiated to propagate over a wide range. For more uniform propagation of sound over a wider range, plural, e.g. two, loudspeakers may be disposed at a location, directing the respective loudspeakers in different directions.

When a plurality of loudspeakers are disposed at one location, however, sounds from the loudspeakers interfere with each other, resulting in peaks and dips in the sound pressure level in the space where the loudspeakers are installed. Such unstable sound pressure level in the space would cause listeners to feel unpleasant or make the sounds difficult to hear.

Therefore an object of this invention is to provide a horn loudspeaker which is free of peaks and dips in sound pressure level and can provide a radiation characteristic suitable for a specific use of the loudspeaker, e.g. such a characteristic as to enable uniform propagation of sound over a wide range.

SUMMARY OF THE INVENTION

A horn loudspeaker according to a first embodiment of the present invention includes an electroacoustic transducer for transducing an electrical signal applied to an input terminal of the loudspeaker to sound. The loudspeaker also includes a hollow sound conduit having its first end coupled to the transducer, for transmitting therethrough the sound emitted by the transducer to the other or second end thereof. A horn is coupled to the second end of the sound conduit for propagating the sound supplied to it from the transducer through the sound conduit, over a desired angular range in at least one propagation plane. The sound conduit is coupled to that portion of a wall of the horn which lies in a plane paralleling the propagation plane.

The horn may be generally flat in its appearance and have at least top and bottom walls facing each other. At least one of the top and bottom walls has a portion lying in a plane paralleling the propagation plane. The sound conduit is coupled to the horn at the portion paralleling the propagation plane. Accordingly, the sound from the sound conduit enters into the horn at an angle with respect to the propagation plane.

The sound conduit can be coupled to the horn at a location deviating from the center of the horn. When the sound conduit is coupled at a location deviating from the center of the horn, a larger amount of the sound is emitted in the direction in which the coupling location deviates, resulting in a higher sound pressure level in that direction.

The sound conduit can be coupled to the horn in such a manner that the sound wave from the sound conduit enters into the horn at an angle with respect to the propagation plane in which the sound wave going out from the horn advances. In this case, the sound wave can propagate easily in the direction in which it is emitted from the sound conduit, so that the sound pressure level in this direction is higher. On the other hand, it is difficult for the sound wave to propagate in the opposite direction and, therefore, the sound pressure level in this opposite direction is lower.

Thus, the amount of sound to be emitted from the horn in a desired direction, i.e. the sound pressure level in the desired direction can be changed by adjusting the position and angle of coupling of the sound conduit with respect to the horn. This enables the control of the polar radiation pattern in the propagation plane. Thus, the polar radiation pattern suitable for a specific use of the loudspeaker can be provided as desired.

The cross-section of the sound conduit in a plane perpendicular to the direction of propagation of the sound wave in the sound conduit may be in a generally straight, elongated shape, e.g. rectangular. This shape of the cross-section equivalently provides a linear sound source for the horn. The linear sound source supplies sound to the horn at an angle with respect to the direction of propagation of the sound going out of the horn.

The sound supplied to the horn from the linear sound source propagates in the propagation plane in two opposite directions perpendicular to the direction of the elongation of the cross-section of the sound conduit. This is equivalent to the use of two sound sources. The polar radiation patterns of these two sound sources and, hence, that of the loudspeaker itself can be controlled by adjusting the position where the sound conduit is coupled and the angle at which the sound conduit is coupled with respect to the horn.

The polar radiation pattern of the loudspeaker is the combination of the polar radiation patterns of the two sound sources. However, these sound sources are virtual ones, and, actually, only one real sound source, i.e. only one transducer is used. Accordingly, although the polar radiation patterns of these virtual sound sources may overlap, no peaks and dips will be developed in the overall polar radiation pattern. Therefore the sound emitted from the loudspeaker does not make listeners unpleasant, or it never happens that the sound is hard to hear.

In this arrangement, the horn may be arranged such that the sound entering into the horn from the sound conduit may propagate from the location where the sound conduit is coupled to the horn over a generally sectorial range in the propagation plane. The direction of the elongation of the cross-section of the sound conduit at the location where the sound conduit is coupled to the horn is along the bisector of the sectorial range.

For that purpose, the shape of the horn may be sectorial or semi-circular when viewed from the direction perpendicular to the propagation plane. Let it be assumed that the forward direction of the horn is the direction from the center of the sector or semi-circle toward the midpoint of the arc of the sector or semi-circle. The sound conduit is coupled to the horn with its cross-section elongated in the forward direction.

Let it be assumed that the sound conduit is coupled to the horn in such a manner that the sound enters into the horn substantially perpendicularly to the propagation plane. Then, the sound emitted from the linear sound source or two virtual sound sources propagates mainly along the two radii connecting the opposite ends of the arc of the sector or semicircle of the horn to its center. If the loudspeaker is disposed with the propagation plane extending horizontally, the sound propagates mainly rightward and leftward. Thus, the sound pressure level of the loudspeaker is higher toward the right and left of the horn and is low along the bisector of the sectorial or semi-circular horn.

If the sound conduit is tilted slightly backward, so that the sound is emitted into the horn slightly in the forward direction, the sound can advance more easily in the forward direction. Then the sounds from the two virtual sound sources propagate mainly in the rightward and leftward directions but slightly toward the bisector. This provides the maximum sound pressure level along these directions. The sounds from the two virtual sound sources are combined in the front area of the horn, and, therefore, the sound pressure level in the front area is higher than the sound pressure level provided there when the sound conduit is coupled to the horn generally perpendicularly to the propagation plane. Thus, the resulting overall polar radiation pattern of the loudspeaker is such that a generally uniform sound pressure level is generated over a relatively wide range extending right and left about the front center portion of the loudspeaker.

If the sound conduit is further tilted backward, the sound can propagate far more easily in the forward direction. Then, the sound from the linear sound source propagates in the directions much closer to the bisector than in the above-described case. In this case, a wide polar radiation pattern is provided in which the sound pressure level is generally constant over a relatively wide angular range about the bisector.

The sound conduit may be tilted rightward or leftward, with the direction of elongation of the cross-section kept to be along the bisector. If the sound conduit is tilted rightward, it is hard for the sound going out of the horn to advance rightward, i.e. the direction in which it is tilted, but the sound can advance more easily leftward, i.e. the opposite direction. Thus, the sound pressure in the rightward direction is smaller, while the sound pressure in the leftward direction is larger. If the sound conduit is tilted leftward, the sound pressure in the leftward direction is smaller, while the sound pressure in the rightward direction is larger.

The horn may be provided with a guide for guiding the sound supplied from the transducer through the sound conduit to propagate in a desired direction. The guiding of the sound by the guide can prevent discontinuity which could occur in the propagation of the sound wave. Thus, the frequency characteristic of the propagating sound is not disturbed, and, therefore, stable sound propagation can be realized.

A plurality of electroacoustic transducers and a plurality of sound conduits associated with the transducers may be provided for the horn. In this arrangement, the second ends of the respective sound conduits are coupled to the horn at locations which are close to each other, and the sound conduits are of substantially the same length.

The use of a plurality of transducers provides higher sound pressure. Also, the use of a plurality of sound conduits enables fine control of the overall polar radiation pattern of the loudspeaker.

Sounds supplied from the respective transducers through the associated sound conduits into the horn may interfere with each other in the horn. However, a peak-and-dip is not developed in a relatively low frequency range for the following reason.

A peak-and-dip is developed when interference occurs between a plurality of sounds having the same frequency which are out of phase with each other. When the sounds are out of phase with each other by a half wavelength ($\lambda/2$), they cancel each other, and, if they are out of phase by one wavelength ($\lambda$), they reinforce each other, resulting in the peak-and-dip phenomenon. Thus, as the phase difference between the sounds is larger, a peak-and-dip tends to occur in a lower frequency range, while a peak-and-dip tends to occur in a higher frequency range as the phase difference is smaller. Accordingly, by making the phase difference less than half of the audio frequency wavelength $\lambda$, e.g. from about $\lambda/3$ to about $\lambda/5$, the generation of peaks and dips in the audio frequency range, which may cause problems in hearing, can be avoided.

According to the present invention, in order to avoid the generation of peaks and dips in the audio frequency range, the second ends of the sound conduits at which the sounds from the transducers are supplied to the horn are positioned in the proximity of each other. The "proximity" used herein means a distance of from about $\lambda/3$ to about $\lambda/5$, where $\lambda$ is the audio frequency sound wavelength. Furthermore, the lengths of the respective sound conduits, i.e. the distances of the horn from the respective transducers through the sound conduits, are made substantially equal to each other so that the difference between the lengths of the paths along which the sounds from the respective transducers travel through the horn can be small, which results in a small phase difference between the sounds.

DETAILED DESCRIPTION OF THE EMBODIMENTS

Now, the present invention is described with reference to FIGS. 1 through 12.

The loudspeaker 1 can be oriented in any direction when it is installed, but, for simplicity of the description given hereinafter, the side shown in FIG. 2(*b*) is defined as the front side of the loudspeaker.

Figure 1:
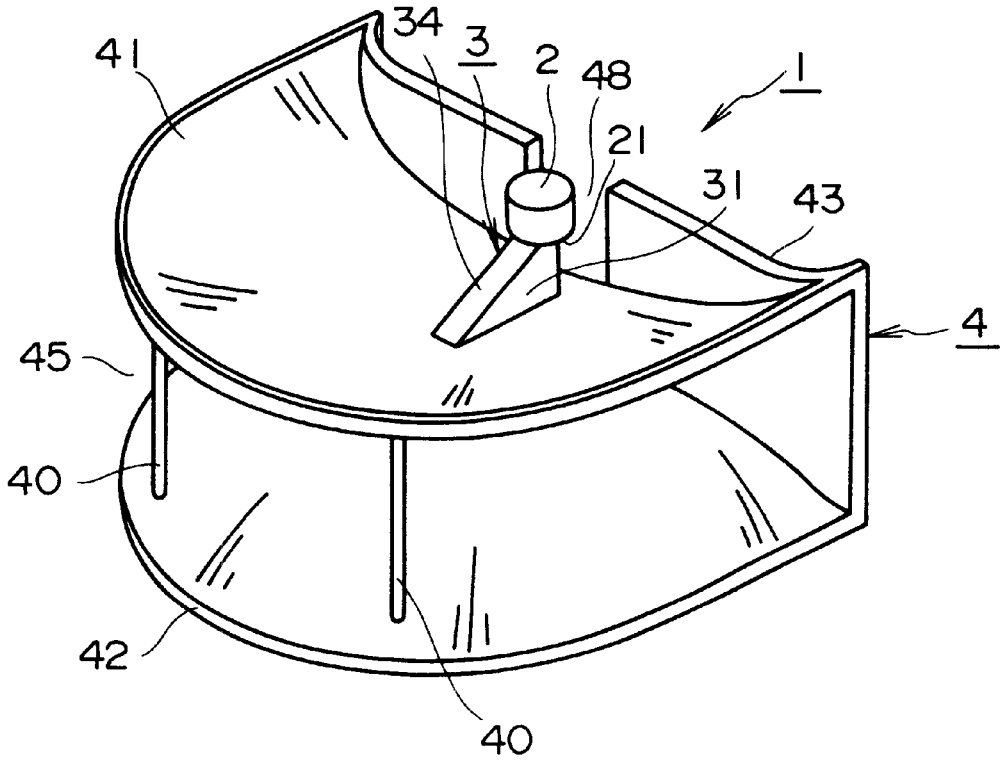
FIG. 1 is a perspective view of an example of a horn loudspeaker according to the present invention.
Figure 2A:
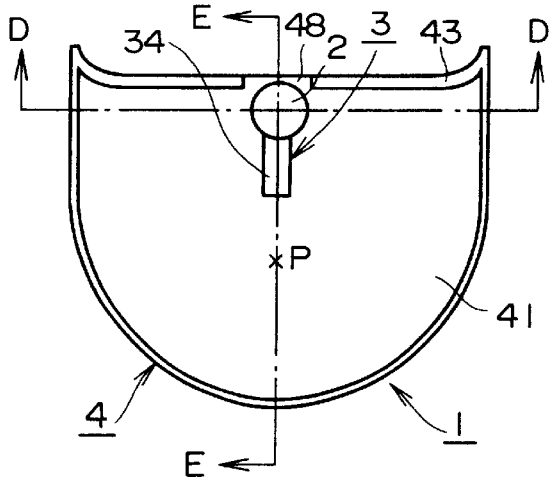
FIG. 2(*a*) is a plan view of the loudspeaker of FIG. 1, FIG. 2(*b*) is a front view, FIG. 2(*c*) is a side view, FIG. 2(*d*) is a cross-sectional view along a line (D)—(D) of the loudspeaker shown in FIG. 2(*a*), and FIG. 2(*e*) is a cross-sectional view along a Hne (E)—(E).
Figure 2B:
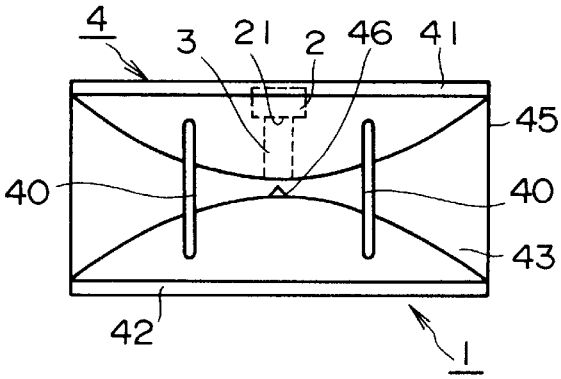
Figure 2C:
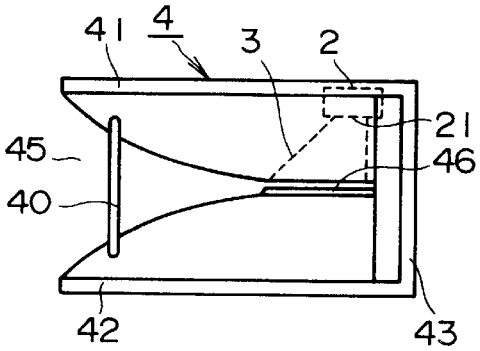
Figure 2D:
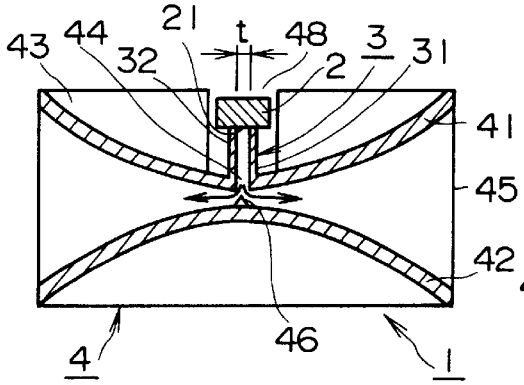
Figure 2E:
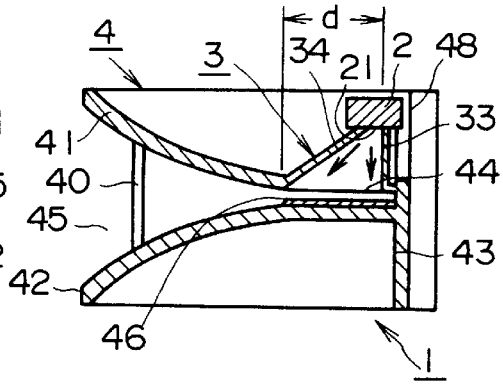

In FIG. 1 and FIGS. 2(*a*) through 2(*e*), the loudspeaker 1 has an electroacoustic transducer 2 for converting an electrical signal applied to an input terminal (not shown) to sound. The sound is emitted from a sound wave emitting surface 21 of the transducer 2. The sound wave emitting surface 21 is oriented vertically downward and is coupled to a first end of a sound conduit pipe 3. Thus, the sound is emitted into the sound conduit pipe 3. Usually, electroacoustic transducers are classified into, for example, a dynamic type, an electromagnetic type and an electrostrictive type, depending on their electroacoustic transducing mechanisms. However, in the present invention, any type of transducer can be used.

The sound conduit pipe 3 is for transmitting the sound emitted from the transducer 2 into its first end to the other or second end. It may be a pipe of rigid plastic, e.g. ABS resin, having a rectangular transverse cross-section. The pipe 3 is formed of four walls 31, 32, 33 and 34. The right and left side walls 31 and 32 extend generally vertically downward from the sound emitting surface 21 of the transducer 2, and they are disposed close to and in parallel with each other. The rear wall 33, too, extends generally vertically downward from the sound emitting surface 21 of the transducer 2. It is disposed generally perpendicular to the side walls 31 and 32.

The front wall 34 of the sound conduit pipe 3 are generally perpendicular to the side walls 31 and 32, but extends downward from the sound emitting surface 21 of the transducer 2 slantwise toward the front side of the loudspeaker. Thus, the shape of the transverse cross-section of the pipe 3 defined by the four walls 31-34 becomes rectangular with its right and left sides becoming longer from the one (transducer-side) end to the second end. The sloping forward of the front wall 34 is equivalent to tilting rearward a sound conduit pipe having a uniform transverse cross-sectional area over its length. Accordingly, instead of the illustrated sound conduit pipe 3, such a rectangular pipe having a uniform transverse cross-sectional area can be used, being tilted rearward.

The outlet of the sound conduit pipe 3 at the second end is coupled to and opens into a horn 4 in a horizontal plane. The length "d" of the opening at the second end of the sound conduit pipe 3 (see FIG. 2(*e*)) is considerably larger than its width "t" (see FIG. 2(*d*)). For example, the ratio of "d" to "t" is from about 8 to about 10. In one example, the length "d" is about 100 mm for the width "t" of about 12 mm.

The horn 4 includes two curved upper and lower plates 41 and 42 and a generally flat rectangular rear plate 43 which couples the curved plates 41 and 42 together. Thus, the horn 4 is flat, and it resembles radial type and sectoral type horns, in its appearance. Specifically, the two curved plates 41 and 42 have generally the same shape and may include halves of a plate having a surface which is a paraboloid of revolution, like a surface of a parabolic reflector. The two plates are spaced from each other with corresponding edges, i.e. the curved, front edges and the rear edges vertically aligned and with their convex sides facing each other at a small distance. The rear edges of the two plates 41 and 42 are coupled to the rear plate 43, and the right and left ends of the rear edges of the plates 41 and 42 are in alignment with the right and left side edges of the rear plate 43.

Thus, the curved edges of the curved plates 41 and 42 and the right and left side edges of the rear plate 43 form an outward opening closed loop.

In the illustrated example, the right and left side edge portions of the rear plate 43 curve slightly rearward, and, the right and left end portions of the curved plates 41 and 42 project slightly rearward accordingly.

A rectangular opening 44 having substantially the same shape and size as the opening in the second end of the sound conduit pipe 3 is formed in the upper curved plate 41 at a location corresponding to the center of the paraboloid of revolution. The location is intermediate between the right and the left side edges and near the rear edge of the plate 41. The second end of the sound pipe 3 is coupled to the upper plate 41 with the end opening in the pipe 3 aligned with the opening 44 and, thus, the sound conduit pipe 3 is coupled to the horn 4 through the opening 44.

The sound reaching the second end of the sound conduit pipe 3 is emitted through the opening 44 into a space defined by the upper and lower plates 41 and 42 and the rear plate 43, i.e. the horn 4. The sound supplied to the horn 4 advances outward, i.e. toward the closed loop, and emitted out of the horn 4. Thus, the opening 44 in the upper plate 41 is a throat of the horn 4 from which sound from the transducer 2 is supplied to the horn 4, and an area 45 within the closed loop is a mouth of the horn 4. As is understood from the illustrations, the sound from the mouth 45 propagates mainly into areas forward of the rear plate 43. The sound is spread radially about the location where the opening 44 is formed and in a plane, i.e. "propagation plane" substantially in parallel with the plane in which the second end of the sound conduit pipe 3 opens into the horn 4.

On the top surface of the lower curved plate 42, there is disposed a guide 46 projecting toward the opening 44 in the upper curve plate 41. The guide 46 is at a location facing the longitudinal center line of the rectangular opening 44. The guide 46 is used to guide the sound supplied from the transducer 2 through the opening 44 into the horn 4 to desired directions. In the illustrated embodiment, the guide 46 is ridge-shaped. The guide 46 is disposed in such a manner that the ridge extends along the longitudinal center line of the opening 44. Thus, as indicated by arrows in FIG. 2(*d*), the sound supplied to the horn 4 is divided and guided to advance in the rightward and leftward directions. The guiding of the sound by the guide 46 enables smooth acoustic coupling between the sound conduit pipe 3 and the horn 4, which avoids acoustic discontinuity in the sound supplied from the sound conduit pipe 3 into the horn 4.

Two vertical support rods 40 support the upper and lower curved plates 41 and 42 in the front portion of the horn 4 at locations shifted right and left from the center. A recess 48 is formed in the rear plate 43 to prevent the transducer 2 from contacting the rear plate 43.

In the embodiment thus far described, the opening 44 through which sound for the horn 4 is supplied can be deemed a sound source for the horn 4. Thus, the sound source is a linear sound source extending in the forward direction. (Hereinafter, the linear sound source may be sometimes referred to by the reference numeral "44" for the opening 44.)

The linear sound source 44 supplies sound to the horn 4 at an angle with respect to the direction or the propagation plane in which the sound goes out from the horn 4.

Accordingly, the sound supplied by the linear source 44 to the horn 4 propagates in the propagation plane, which is a horizontal plane in the illustrated example, in the rightward and leftward directions. This is equivalent to using of two sound sources emitting sound rightward and leftward of the horn 4, as schematically shown in FIG. 3.

Figure 3:
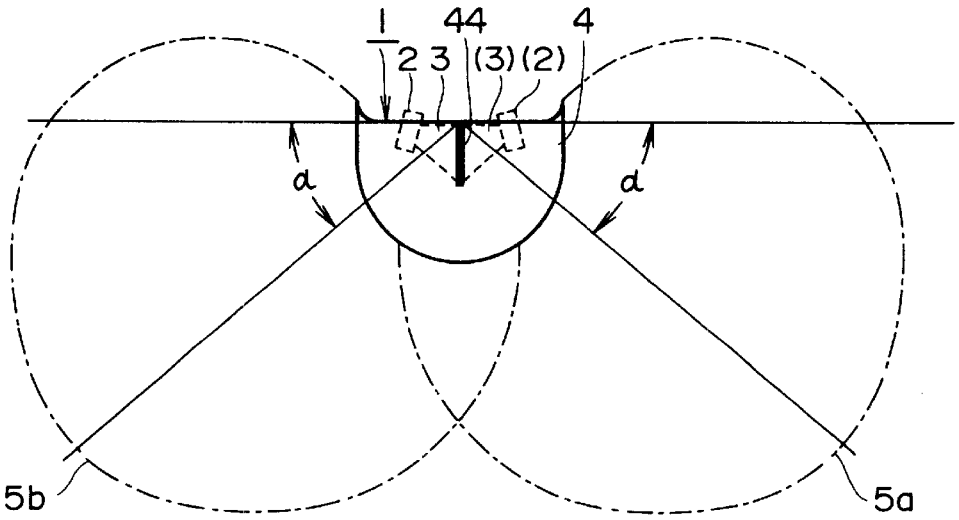
FIG. 3 is a schematic illustration of the polar radiation patterns of two virtual transducers equivalent to the single transducer shown in FIG. 1.

As shown in FIG. 3, it is as if there were two sound sources each including a transducer 2 and a sound conduit 3, of which the polar radiation patterns are formed on the right and left sides of the horn 4 as indicated by dash-and-dot lines 5*a* and 5*b*.

It should be note, however, that the polar radiation patterns 5*a*, 5*b* of the two virtual sound sources shown in FIG. 3 swell in an obliquely forward directions rather than in the straight rightward and leftward directions. That is, a highest sound pressure level appears at locations on lines at an angle of a with respect to the lateral direction. This is due to the structure of the sound conduit pipe 3 in which the front wall 34 slants forward. Due to this structure, the sound emitted from the transducer 2 enters into the horn 4 somewhat diagonally forward, so that the sound can advance easily forward. This results in the polar radiation patterns 5*a* and 5*b* having a largest sound pressure level at locations deviating more or less forward from the lateral direction.

Figure 4:
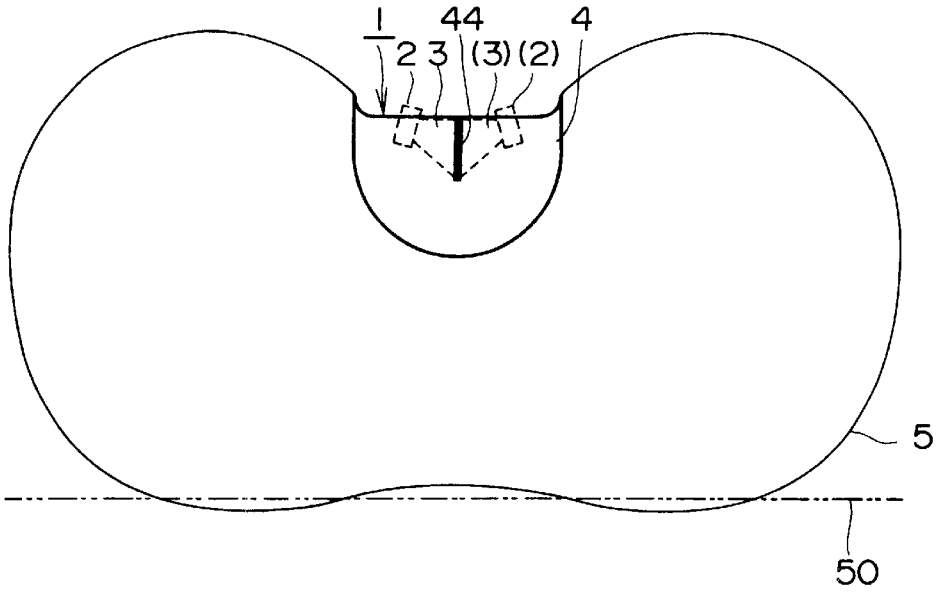
FIG. 4 is an overall polar radiation pattern of the loudspeaker of FIG. 1 resulting from the polar radiation patterns shown in FIG. 3.

Then, the polar radiation pattern of the loudspeaker 1 as a whole is as represented by a solid line 5 in FIG. 4, which is substantially equivalent to the combination of the polar radiation patterns 5*a* and 5*b* of the two virtual sound sources. As shown, with the polar radiation pattern 5, a generally uniform sound pressure level can be provided over a relatively wide range extending from the center to the right and left sides in front of the horn 4, as indicated by a line 50.

Figure 5:
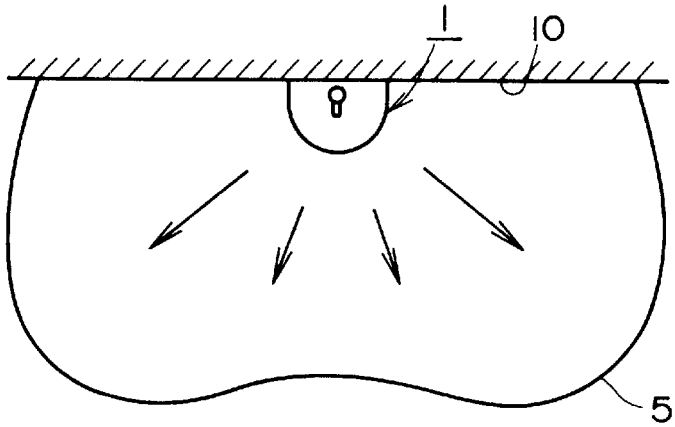
FIG. 5 illustrates how the polar radiation pattern of the loudspeaker of FIG. 1 can be when it is installed on a ceiling.

Since the two sound sources are virtual, and the loudspeaker 1 actually has only one sound source, no peaks and dips are seen in the polar radiation pattern 5 of the loudspeaker 1, though it is the combination of the polar radiation patterns 5*a* and 5*b* of the two virtual sound sources.

Where it is desired to provide sound uniformly over a linearly extending audience area, e.g. a hallway or corridor, the loudspeaker 1 is installed on a ceiling 10 of the corridor as shown in FIG. 5, with the front portion of the horn 4 facing downward. Then, the loudspeaker 1 can provide a uniform sound pressure level over the corridor. Furthermore, since no peaks and dips are produced, the sound does not make the audience unpleasant. Also, the sound can be heard clearly.

The loudspeaker 1 has been described as being installed on a wall or on a ceiling, but the present invention can be embodied in other types of loudspeakers, such as a loudspeaker to be mounted in an enclosure.

The guide 46 is disposed to avoid acoustic disturbances in the sound wave supplied into the horn 4 from the transducer 2 through the sound conduit pipe 3, but it may be eliminated if there is no fear that such acoustic disturbances may occur.

The spacing between the curved plates 41 and 42 of the horn 4 exponentially increases outward, i.e. toward the mouth 45 of the horn 4, from the location where the sound conduit pipe 3 opens into the horn 4 (exponential horn). However, the shape of the horn 4 is not limited to the one exemplified in FIGS. 1 through 5, but other shapes may be used for different purposes. For example, the facing plates 41 and 42 may have curvatures curving in the opposite sense to the one shown in FIGS. 1 and 2(*a*) through 2(*e*), so that the spacing between the plates 41 and 42 varies parabolically from the inside toward the outside (parabolic horn).

The inside surfaces of the facing plates 41 and 42 may be flat so that the distance between the plates 41 and 42 linearly increases at a constant rate in the forward direction. In another example, the plates 41 and 42 may be flat and disposed in parallel with each other so that the shape of the horn 4 may be similar to that of a radial horn.

The sound conduit pipe 3 is coupled to the horn 4 at a rather rear portion of the horn 4 in the example illustrated in FIGS. 1–5, but it may be coupled to the horn 4 at a rather front portion of the horn 4, i.e. at a position P shown in FIG. 2(*a*). By moving forward the location where the pipe 3 is coupled to the horn 4, the polar radiation pattern of the loudspeaker 1 changes, so that the sound pressure level in the area in the forward direction of the horn 4 increases. In addition, the sound is propagated in the rearward direction or, in particular, in the rear right and rear left directions, too. Depending on the use of the loudspeaker 1, the location where the sound conduit pipe 3 is coupled to the horn 4 may be other than the above-described positions, which provides different polar radiation patterns.

The polar radiation pattern 5 of the loudspeaker 1 can be varied by employing different angles at which the sound conduit pipe 3 is coupled to the horn 4. (For the illustrated sound conduit pipe 3, the sloping angle of the front wall 34 may be changed, instead of changing the angle of the sound conduit pipe 3 with respect to the horn 4.)

Figure 6:
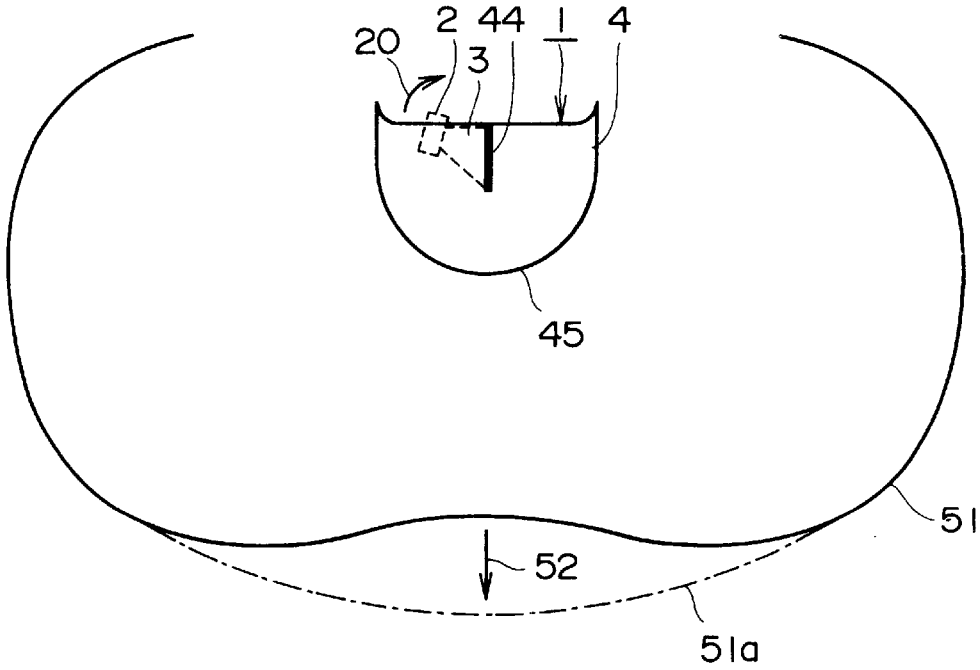
FIG. 6 illustrates how to modify the polar radiation pattern of the loudspeaker.

For example, as indicated by an arrow 20 in FIG. 6, by tilting the sound conduit pipe 3 rearward, the sound wave discharged into the horn 4 from the sound conduit pipe 3 can more easily advance in the forward direction than in the example described and shown in FIGS. 1–5. This results in the two polar radiation patterns in which the location where the highest sound pressure appears moves further toward the front of the horn 4. As a result, the pressure of the sound emitted from the horn 4 in the area in front of the horn 4 increases as indicated by an arrow 52, which results in a polar radiation pattern 51*a* shown in FIG. 6.

Figure 7:
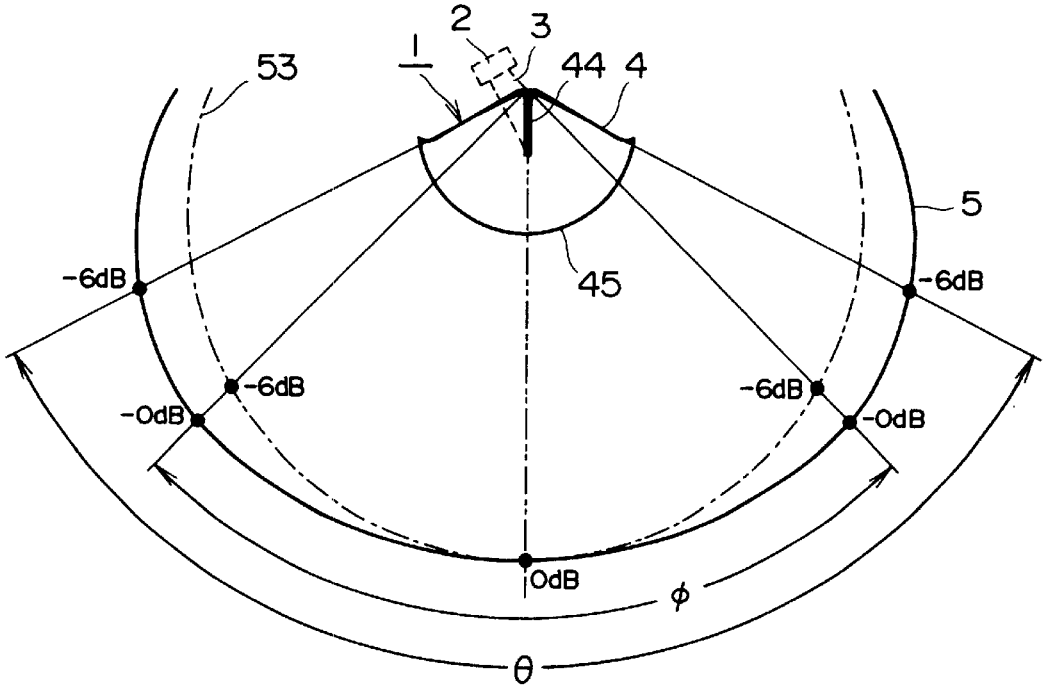
FIG. 7 shows an example of polar radiation patterns realizable by the present invention.

Using the technique illustrated in FIG. 6, a loudspeaker having a wider range radiation characteristic as shown in FIG. 7 can be realized. Specifically, by tilting the sound conduit pipe 3 further rearward, the highest pressure point on each of the polar radiation patterns of the two virtual sound sources moves further toward the front of the horn. This results in reduction of the sound pressure in the areas on the right and left sides of the loudspeaker 1 and in increase of the sound pressure in the area in front of the loudspeaker. Thus, the tilt angle of the sound conduit pipe 3 with respect to the horn 4 or, more specifically, to the plane in which the linear sound source or opening 44 lies can be adjusted such that the sound pressure can be substantially uniform over a wide angular range θ as indicated by a solid line 5 shown in FIG. 7.

In FIG. 7, a polar radiation pattern 53 of an ordinary loudspeaker is also shown. Comparison of the pattern 5 of the loudspeaker 1 according to the present invention with the pattern 53 of the ordinary loudspeaker indicates that the angular range θ of the present invention is wider than the corresponding angular range ϕ of the ordinary loudspeaker. For example, while the angle ϕ is from about 90° to about 100°, the angle θ is 120° or larger.

Figure 8:
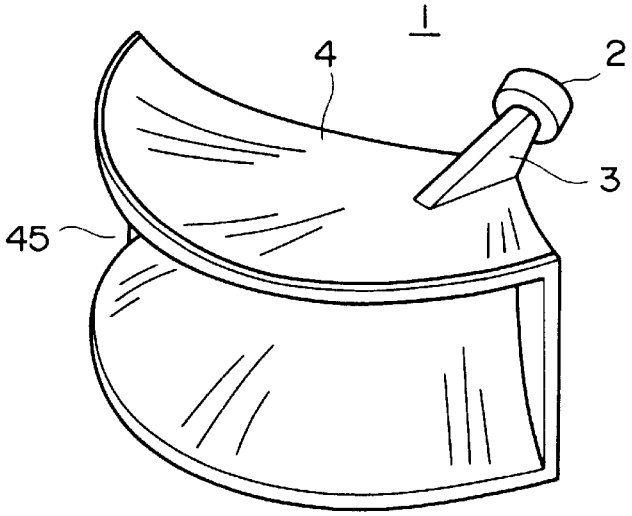
FIG. 8 is a perspective view of a loudspeaker which provides the polar radiation pattern shown in FIG. 7.
Figure 9:
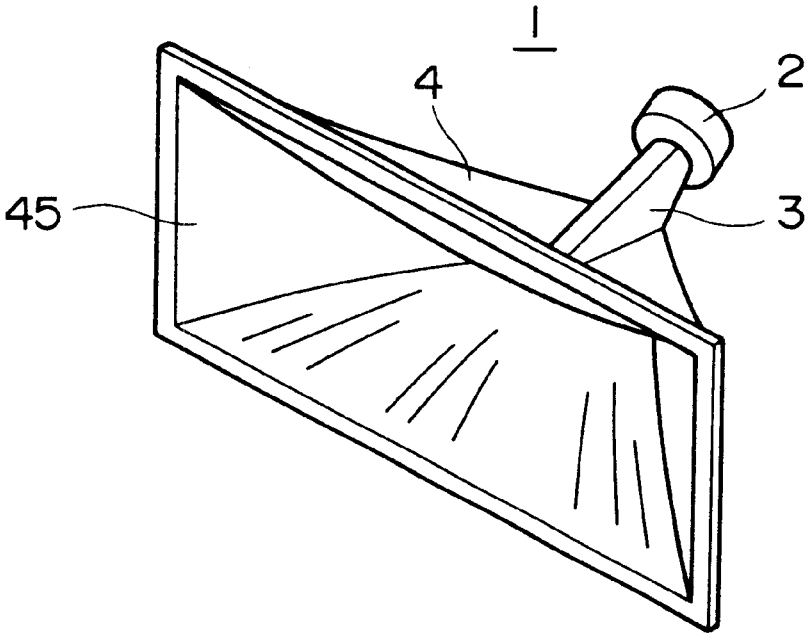
FIG. 9 is a perspective view of another loudspeaker which can provide the polar radiation pattern shown in FIG. 7.

The example illustrated in FIG. 7 is designed to provide substantially constant sound pressure over the desired angular range θ of about 120° or so, and, therefore, the mouth 45 of the horn 4 of FIG. 7 is not so wide as the mouth of the horn 4 of the example shown in FIGS. 1–5, but it is open over the angle of 0. An example of such loudspeaker is shown in FIG. 8. The shape of the horn 4 shown in FIG. 8 is sectoral. In place of the shape shown in FIG. 8, the horn 4 may have a shape as shown in FIG. 9, which is the same as the one shown in FIG. 8 except that the front arcuate portions of the upper and lower plates are removed.

Figure 10:
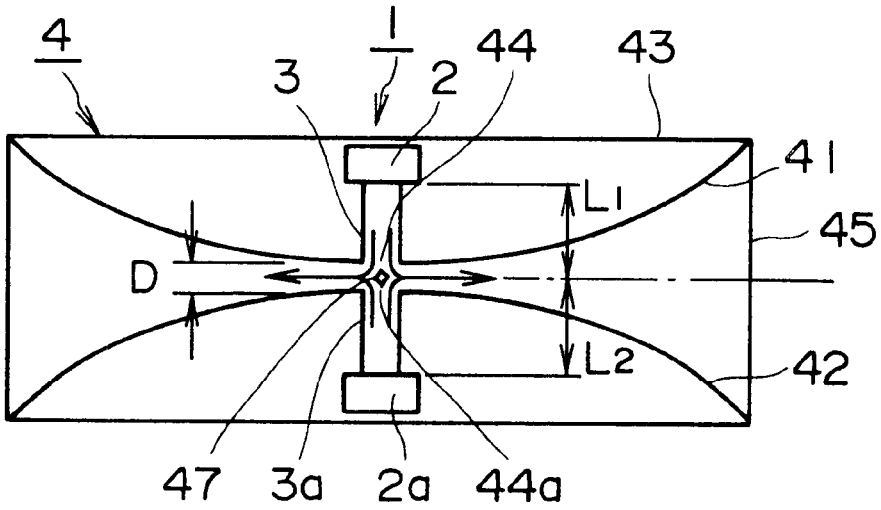
FIG. 10 shows a loudspeaker according to the present invention, which includes two electroacoustic transducers.

The above-described embodiments employ only one transducer. The sound strength can be increased by using a plurality of transducer. In such a case, however, peaks and dips should be generated due to interference between the sounds from the transducers. Accordingly, it is necessary to make such peaks and dips cause no troubles to the auditory sense of audience. For that purpose, an arrangement as shown in FIG. 10 may be employed when two transducers are used.

In this example, a transducer 2*a* similar to the transducer 2 of the loudspeaker 1 described above is coupled to the curved plate 42 of the horn 4 through a sound conduit pipe 3*a* similar to the sound conduit pipe 3. The positional relationship between the transducer 2*a* and the sound conduit pipe 3*a* is the same as the one between the transducer 2 and the sound conduit pipe 3. The transducer 2*a* is disposed at a position symmetrical with the position of the transducer 2, and the sound conduit pipe 3*a* is disposed at a position symmetrical with the position of the sound conduit pipe 3. An opening 44*a* similar to the opening 44 in the plate 41 is provided in the curved plate 42 at the location where the pipe 3*a* is coupled. A guide 47, which is equivalent to two guides 46 shown in FIGS. 1–7 bonded back to back together, is disposed intermediate between the two openings 44 and 44*a* and has its first end coupled to the rear plate 43. The second end of the guide 47 is free. The guide 47 guides the sounds emitted by the transducers 2 and 2*a* into the horn 4 through the respective sound conduit pipes 3 and 3*a*. The sounds advance rightward and leftward of the guide 47.

With the above-described arrangement, the sounds from the transducers 2 and 2*a* are discharged into the horn 4 at locations close to each other. Also, the distances of the transducers 2 and 2*a* from the horn 4, i.e. the lengths $L_1$ and $L_2$ of the paths along which the sounds from the respective transducers 2 and 2*a* travel to the horn 4 are substantially equal to each other. Accordingly, although peaks and dips occur due to interference in the horn 4, the phase difference between the sound supplied through the sound conduit pipe 3 and the sound supplied through the sound conduit pipe 3*a* is small, so that the frequencies at which peaks and dips occur are high. This is because peaks and dips are produced when a plurality of sounds that have the same frequency but are out of phase with each other, interfere with each other, and as the phase difference is smaller, the frequency at which peaks and dips occur is higher. A distance smaller than the wavelength $\lambda$ of the audio frequency, e.g. a distance smaller than $\lambda/2$ or, more particularly, from $\lambda/3$ to $\lambda/5$ (=about 6 mm to about 3.5 mm), may be employed as the distance D between the openings 44 and 44*a* from which the sounds from the transducers 2 and 2*a* are discharged into the horn 4, so that the occurrence of peaks and dips in the audio frequency range can be avoided.

Figure 11:
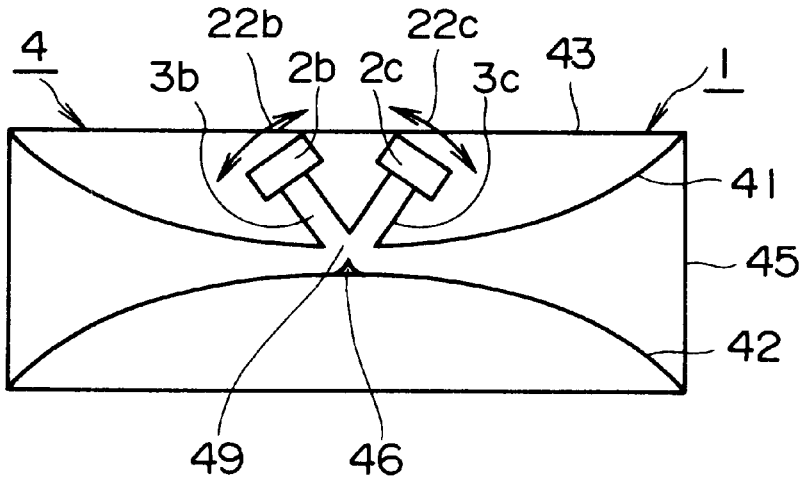
FIG. 11 shows another example of loudspeakers according to the present invention.
Figure 12:
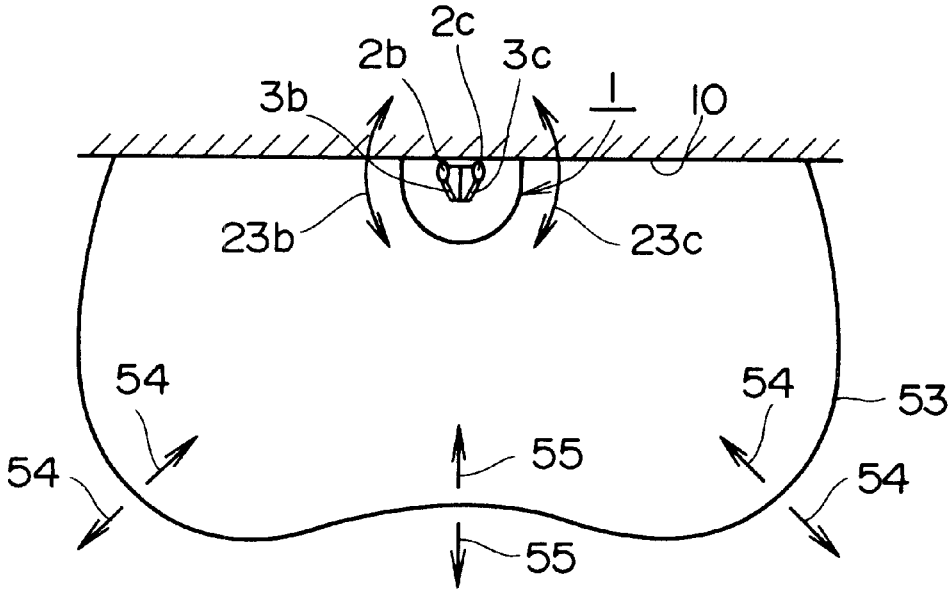
FIG. 12 illustrates the loudspeaker shown in FIG. 11 installed on a ceiling.
Figure 13A:
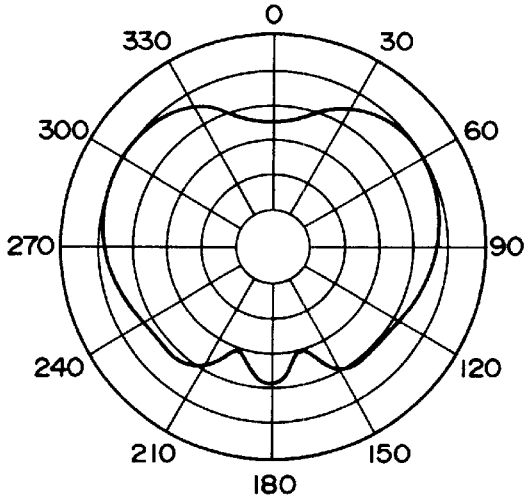
FIGS. 13(*a*), 13(*b*), 13(*c*) and 13(*d*) show experimentally determined polar radiation patterns at various frequencies of the loudspeaker shown in FIG. 11 installed on a ceiling.
Figure 13B:
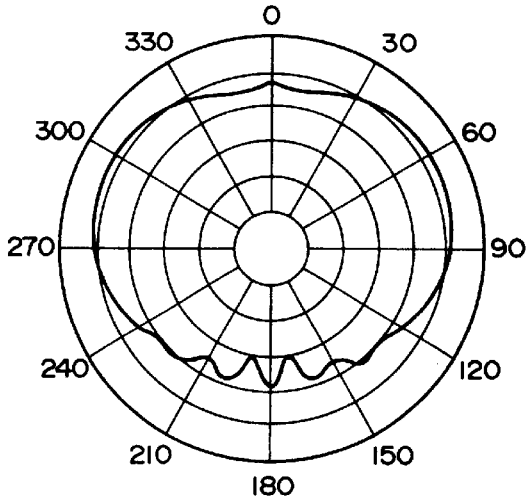
Figure 13C:
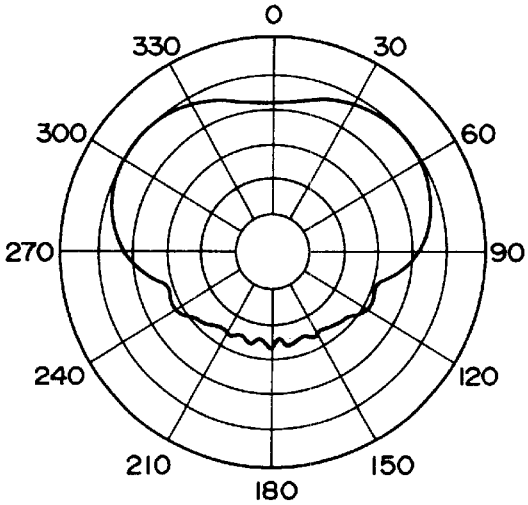
Figure 13D:
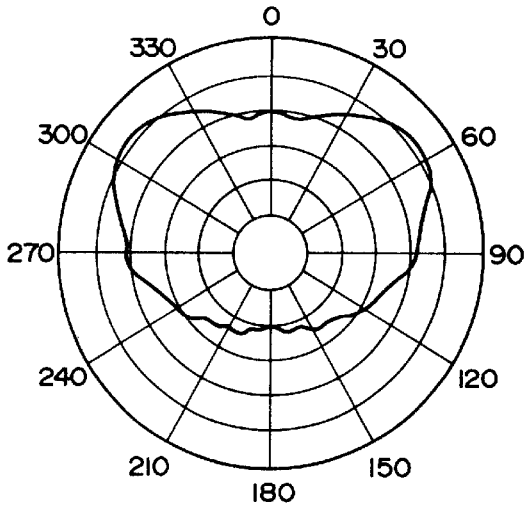

Another example of a loudspeaker according to the present invention is shown in FIG. 11, which also employs two transducers 2*b* and 2*c* and, therefore, two sound conduit pipes 3*b* and 3*c*. The transducers 2*b* and 2*c* are similar to the transducer 2, and the sound conduit pipes 3*b* and 3*c* are similar to the pipe 3. As in the above-described examples, the transducers 2*b* and 2*c* are coupled to the first ends of the associated sound conduit pipes 3*b* and 3*c*. The other or second ends of the respective sound conduit pipes 3*b* and 3*c* are coupled to the horn 4 at closely adjacent locations on the same curved plate 41 or 42, so that the openings (44) through which sounds enter into the horn 4 overlap, resulting in a single opening 49 having a width slightly larger than that of the single opening 44. The sound conduit pipes 3*b* and 3*c* are tilted rightward and leftward. The use of the two transducers increases the sound volume. The rightward and leftward tilting angle of the pipes 3*b* and 3*c* may be varied as indicated by arrows 22*b* and 22*c* so that the sound radiation characteristic or polar radiation pattern 53 of the loudspeaker 1 can be adjusted in the sense as indicated by arrows 54 shown in FIG. 12. Also, as shown in FIG. 12, by varying the angle of the tilting rearward or forward of the respective sound conduit pipes 3*b* and 3*c* as indicated by arrows 23*b* and 23*c*, the polar radiation pattern 53 can be adjusted in the sense as indicated by arrows 55.

The polar radiation patterns at various frequencies f, namely, 1,250 Hz, 2,500 Hz, 5,000 Hz and 10,000 Hz, of the sound emitted from the loudspeaker 1 shown in FIGS. 1–5 are shown in FIGS. 13(*a*) through 13(*d*). As is understood from FIGS. 13(*a*) through 13(*d*), for each of the frequencies, a substantially uniform sound pressure level is obtained for an area extending from the front toward the front right and left sides.

What is claimed is:

1. A horn loudspeaker comprising:

an electroacoustic transducer for converting an electrical signal adapted to be applied to an input terminal thereof into sound;

a sound conduit having first and second ends with said first end coupled to said transducer, for transmitting sound emitted by said transducer to said second end thereof, wherein a cross-section of said sound conduit in a plane perpendicular to the direction of propagation of the sound in said sound conduit has a straight, elongated shape, and a horn coupled to said second end of said sound conduit for propagating the sound supplied through said sound conduit in a desired direction in at least one propagation plane;

wherein said sound conduit is coupled to that position of a wall of said horn which lies in a plane paralleling said propagation plane; and said horn is arranged in such a manner that the sound is propagated from said portion of said horn where said second end of said sound conduit is coupled over a sectoral range in said propagation plane, and the direction of elongation of the cross-section of said sound conduit at said second end is along the bisector of the sectoral range.

2. The horn loudspeaker according to claim 1 further comprising a guide for guiding the sound supplied to said horn from said transducer through said sound conduit in a predetermined direction.

3. The horn loudspeaker according to claim 1 wherein a plurality of combinations of electroacoustic transducer and sound conduit are used, the second ends of said respective sound conduits being coupled to said horn at locations in proximity to each other, the lengths of said sound conduits being substantially equal to each other.

* * * * *